US006232715B1

(12) United States Patent
L'Hermite

(10) Patent No.: US 6,232,715 B1
(45) Date of Patent: May 15, 2001

(54) PHOTOELECTRIC MULTIPLIER TUBE OF REDUCED LENGTH

(75) Inventor: Pierre L'Hermite, Brive (FR)

(73) Assignee: Photonis, Brive-la-Gaillarde (FR)

( * ) Notice: Subject to any disclaimer, the term of this patent is extended or adjusted under 35 U.S.C. 154(b) by 0 days.

(21) Appl. No.: 09/341,701

(22) PCT Filed: Jan. 26, 1998

(86) PCT No.: PCT/IB98/00097

§ 371 Date: Jul. 27, 1999

§ 102(e) Date: Jul. 27, 1999

(87) PCT Pub. No.: WO98/33202

PCT Pub. Date: Jul. 30, 1998

(30) Foreign Application Priority Data

Jan. 28, 1997 (FR) ..... 97 00898

(51) Int. Cl.[7] ..... H01J 43/06

(52) U.S. Cl. ..... 313/533; 313/103 CM; 313/105 CM

(58) Field of Search ..... 313/533–542, 313/103 R, 103 CM, 104, 105 R, 105 CM

(56) References Cited

U.S. PATENT DOCUMENTS 4,575,657 * 3/1986 Kaiser ..... 313/533
5,510,674 * 4/1996 Kyushima et al. ..... 313/533
5,598,061 * 1/1997 Nakamura et al. ..... 313/105 R
5,914,561 * 6/1999 Venkatrao et al. ..... 313/533

FOREIGN PATENT DOCUMENTS

0495589 * 7/1992 (EP) .
0671757 * 9/1995 (EP) .

* cited by examiner

*Primary Examiner*—Ashok Patel
(74) *Attorney, Agent, or Firm*—Oblon, Spivak, McClelland, Maier & Neustadt, P.C.

(57) ABSTRACT

This invention relates to a photomultiplier tube including: a photocathode PK with a semi-transparent photo-sensitive layer provided to emit an electron flux towards the inside of the tube, focusing optics comprising a first dynode D1, concave on the side of the photocathode PK, and several Rajkman dynodes D3, . . . , D8 located on each side of a plane called the dynodes plane DP. According to the invention, the focusing optics also includes a second dynode D2 concave on the side of the re-emitting surface of the first dynode D1, the angle between the plane of the dynodes DP and the center line of the tube exceeding 45°, the concave side of the first Rajkman dynode D3 facing the re-emitting surface of the second dynode D2.

4 Claims, 1 Drawing Sheet

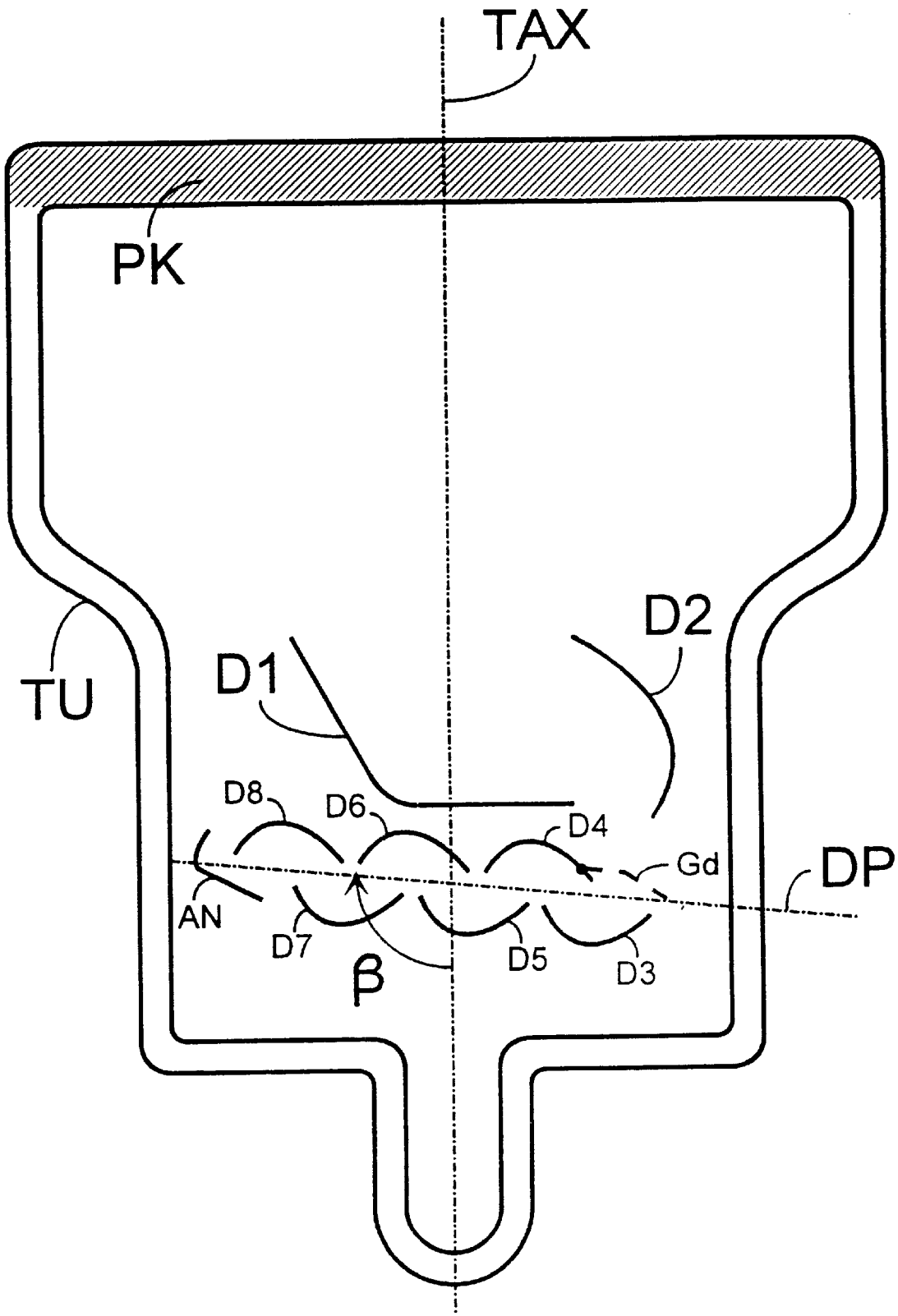
TAX
PK
TU
D1
D2
D8
D6
D4
Gd
DP
AN
D7
D5
D3
β

PHOTOELECTRIC MULTIPLIER TUBE OF REDUCED LENGTH

This invention relates to a photomultiplier tube comprising:

a photocathode designed to be raised to a first electrical potential and with a semi-transparent photo-sensitive layer designed to receive an illumination from outside the tube and to transmit an electron flux into the tube, the density of the flux depending on the intensity of the illumination received by the photocathode, focusing optics comprising a first dynode that will be raised to a second electrical potential, the value of which is higher than the first potential, that is provided with a "re-emitting" surface composed of a material encouraging secondary emission phenomena, the said surface being concave on the side of the photocathode, and, several Rajkman dynode laid out on each side of a plane called the dynode plane. The first of the dynode closest to the output from the focusing optics will be raised to a third electrical potential, the value of which is higher than the potential of the second dynode, each of the subsequent dynode will be raised to an electrical potential higher than the potential of the preceding dynode, this series of dynode being designed to receive and amplify the electron flux from the focusing optics.

In most photomultiplier tubes that use Rajkman dynode based on the principle described above, the dynode plane is parallel to the center line of the tube. Therefore the dimension of the tube along this axis, called the tube length, is large. This may be prohibitive for many applications, for example when the tube is used within a gamma-camera for detection of radiation, it is desirable to use short tubes in order to reduce the size of the device in which they are fitted.

The purpose of the invention is to overcome this disadvantage by proposing a photomultiplier tube in which the plane of the dynode is not parallel to the center line of the tube.

A photomultiplier tube as described in the introductory paragraph is characterized according to this invention in that the focusing optics also comprise a second dynode that will be raised to a potential which is intermediate between the potential of the second and third dynode, the second dynode having a concave re-emitting surface on the side of the re-emitting surface of the first dynode, and in that the angle between the plane of the dynode and the center line of the tube, defined as being a center line perpendicular to the photocathode at its midpoint, exceeds 45°, the concave side of the first Rajkman dynode facing the re-emitting surface of the second dynode.

In this type of photomultiplier tube, the dimension along the length due to the series of Rajkman dynode reduces as the angle between the plane of the dynodes and the center line of the tube increases. The second dynode redirects the electron flux output from the first dynode towards the first Rajkman dynode. The second dynode may beneficially be equipped with a conducting grid placed across the path followed by the electron flux between the first and the second dynode, the potential of this grid being made similar to the potential of the second dynode.

In one particular embodiment of the invention, the angle between the plane of the dynodes and the center line of the tube is close to 90°.

With this configuration, the influence of the series of Rajkman dynodes along the total length of the tube can be reduced by a maximum amount.

In one preferred embodiment of the invention, a photomultiplier tube like the tube described above is characterized in that it comprises a grid placed between the second dynode and the first Rajkman dynode, that will be raised to electrical potential similar to the potential of the second Rajkman dynode.

The presence of the grid increases the collection efficiency at the first Rajkman dynode, in other words the ratio between the number of electrons received by the said dynode and the number of electrons transmitted by the second dynode. The grid generates a local electric field approximately parallel to the path between the second dynode and the first Rajkman dynode, which accelerates electrons in its neighborhood and directs them towards the first Rajkman dynode.

BRIEF DESCRIPTION OF DRAWINGS

The sole FIGURE shows a structure of the Photomultiplier tube according to the invention.

The invention will be better understood by means of the following description of one embodiment given as a non-restrictive example with reference to FIG. 1, which diagrammatically shows a sectional view of a photomultiplier tube according to the invention. The plane of the section is parallel to an axis TAX, called the tube axis, and is perpendicular to a plane called the dynodes plane, which intersects with the plane of the section along a line shown on the diagram as DP. The photomultiplier tube comprises an external glass casing TU, for example which may have a symmetry of revolution about the center line of tube TU, and which has a surface perpendicular to the center line of the tube TAX on which a photocathode PK is fitted that will be raised to a first electrical potential and on which a semi-transparent photo-sensitive layer is formed. This photomultiplier tube also comprises focusing optics comprising a first dynode D1 that will be raised to a second electrical potential at a value that is higher than the first potential, with a "re-emitting" surface composed of a material encouraging secondary emission phenomena, the said surface being concave on the side of the photocathode PK. The focusing optics also comprise the second dynode D2 that will be raised to a potential, the value of which exceeds the value of the second potential, and which has a concave re-emitting surface on the side of the re-emitting surface of the first dynode D1. The photomultiplier tube also comprises several Rajkman dynodes D3, . . . , D8, that will receive and amplify the electron flux from the focusing optics, and dynodes on each side of the plane of the dynodes, the first of which, D3, is closest to the second dynode D2 and which will be raised to a third electrical potential, the value of which exceeds the value of the potential of the second dynode D2. The concaveness of the first Rajkman dynode D3 faces the re-emitting surface of the second dynode D2. Each of the subsequent dynodes D4, . . . , D8 will be raised to an electrical potential that exceeds the potential of the preceding dynode. The angle, β, between the center line DP and the center line of the tube TAX is close to 90°. Finally, the photomultiplier tube comprises a grid Gd, for example made of conducting rods, located between the second dynode D2 and the first Rajkman dynode D3, and which will be raised at an electrical potential similar to the potential of the second Rajkman dynode D4.

When the photocathode PK is illuminated, and the energy of the received photons is sufficiently high, the photosensitive layer emits an electron flux towards the inside of the tube, the density of which thus depends on the illumination intensity. These electrons are collected by the first dynode D1, due to the difference in potential between the first dynode D1 and the photocathode PK that creates an electrical field from the first dynode D1 towards the photocathode PK. The first dynode D1 re-emits a larger number of electrons than it collects, due to secondary emission phenomena well known to a specialist in the subject, and thus performs a first amplification of the density of the electron flux. Electrons re-emitted by the first dynode D1 are collected by the second dynode D2, due to the difference in potential between the second dynode D2 and the first dynode D1 which creates an electrical field directed from the second dynode D2 towards the first dynode D1. Electrons re-emitted by the second dynode D2 are accelerated by the electrical field existing locally around the grid Gd, which directs them to the first Rajkman dynode D3, which thus has a very high collection efficiency. Finally, the electron flux is subject to successive amplifications made by Rajkman dynodes according to a process known to an expert in the subject, and which there is no need to develop here, before reaching an anode AN that forms the output from the tube and restores electronic information representing the illumination received by the photocathode PK.

Therefore, the structure of the focusing optics D1, D2, is such that the electron flux can be redirected towards the first Rajkman dynode when the angle between the plane of the dynodes and the center line of the tube TAX is large. The usefulness of this arrangement is obvious in this example, in which the angle β is close to 90°, so that the length necessary for the series of Rajkman dynodes D3, . . . , D8 can be minimized, thus minimizing the total length of the tube.

What is claimed is:

1. Photomultiplier tube comprising:

a photocathode (PK) designed to be raised to a first electrical potential and provided with a semi-transparent photo-sensitive layer designed to receive an illumination from outside the tube and to transmit an electron flux into the tube, the density of the flux depending on the intensity of the illumination received by the photocathode, focusing optics comprising a first dynode (D1) configured to be raised to a second electrical potential, the value of which is higher than the first potential, that is provided with a "re-emitting" surface composed of a material encouraging secondary emission phenomena, the said surface being concave on the side of the photocathode, and, several Rajkman dynodes (D3 to D8) laid out on each side of a plane (DP) called the dynodes plane, the first of the said several Rajkman dynodes (D3) being closest to the output from the focusing optics raised to a third electrical potential, the value of which is higher than the second potential, each of the subsequent dynodes raised to an electrical potential higher than the potential of the preceding dynode, this series of dynodes being designed to receive and amplify the electron flux from the focusing optics, the focusing optics also comprising a second dynode (D2) configured to be raised to a potential which is intermediate between the second and third potentials, he second dynode having a concave re-emitting surface on the side of the re-emitting surface of the first dynode (D1), the angle between the plane of the dynodes (DP) and the tube axis (TAX), defined as being an axis perpendicular to the photocathode at its midpoint, exceeding 45°, characterized in that the concave side of the first Rajkman dynode (D3) faces the re-emitting surface of the second dynode (D2).

2. Photomultiplier tube according to claim 1, characterized in that the angle between the plane of the dynodes (DP) and the tube axis (TAX) is close to 90°.

3. Photomultiplier tube according to one of claims 1 or 2, characterized in that it comprises a grid (Gd) located between the second dynode (D2) and the first Rajkman dynode (D3) and configured to be raised to an electrical potential similar to the electrical potential of the second Rajkman dynode (D4).

4. Photomultiplier tube according to claim 3, in which the grid (Gd) is composed of conducting bars.

* * * * *